US009055852B2

(12) United States Patent
Tuman et al.

(10) Patent No.: US 9,055,852 B2
(45) Date of Patent: Jun. 16, 2015

(54) CLEANING TOOL

(75) Inventors: Scott J. Tuman, Woodbury, MN (US); Robert J. Maki, Hudson, WI (US); Lloyd S. Vasilakes, Stillwater, MN (US); Byron E. Trotter, Saint Paul, MN (US); Scott D. Gullicks, Apple Valley, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 2177 days.

(21) Appl. No.: 11/953,542

(22) Filed: Dec. 10, 2007

(65) Prior Publication Data

US 2009/0144923 A1 Jun. 11, 2009

(51) Int. Cl.
*A47L 13/256* (2006.01)

(52) U.S. Cl.
CPC ..... *A47L 13/256* (2013.01)

(58) Field of Classification Search
CPC ..... A47L 13/20; A47L 13/256; A47L 13/24; A47L 13/258; A47L 13/16; A47L 13/254
USPC ..... 15/228, 231, 210.1
See application file for complete search history.

(56) References Cited

U.S. PATENT DOCUMENTS

| | | | | |
|---|---|---|---|---|
| 3,875,609 | A * | 4/1975 | Wells | 15/210.1 |
| 7,096,531 | B2 | 8/2006 | Policicchio | |
| D544,667 | S | 6/2007 | Nelson et al. | |
| D547,069 | S | 7/2007 | Braithwaite et al. | |
| D549,415 | S | 8/2007 | Trotter et al. | |
| D552,815 | S | 10/2007 | Bar-Noy et al. | |
| 7,540,056 | B2 * | 6/2009 | Dotterman et al. | 15/228 |
| 7,607,192 | B2 | 10/2009 | Flora et al. | |
| D606,719 | S * | 12/2009 | Robertson et al. | D32/50 |
| 2006/0168750 | A1 | 8/2006 | Dotterman et al. | |
| 2007/0094829 | A1 | 5/2007 | Dotterman et al. | |
| 2007/0136967 | A1 | 6/2007 | Tochacek et al. | |
| 2007/0136973 | A1 | 6/2007 | Patel et al. | |
| 2007/0169292 | A1 | 7/2007 | Cabrero Gomez et al. | |

FOREIGN PATENT DOCUMENTS

| | | |
|---|---|---|
| JP | 6-311954 | 11/1994 |
| WO | WO 2006/113252 A2 | 10/2006 |
| WO | WO 2007/053380 A1 | 5/2007 |

* cited by examiner

*Primary Examiner* — Robert Scruggs
(74) *Attorney, Agent, or Firm* — Ann K. Gallagher

(57) ABSTRACT

A floor cleaning tool is disclosed. The floor cleaning tool comprises a mop head including a perimeter, a working surface and back surface, opposite the working surface. The working surface includes a contact surface and a recessed surface. The contact surface is on a portion of the working surface for making contact with the surface to be cleaned. The contact surface includes a first capturing edge and a second capturing edge. The recessed surface is on a portion of the working surface and includes a first side surface recessed from the first capturing edge of the contact surface and a second side surface recessed from the second capturing edge of the contact surface. The entire contact surface is nonlinear.

10 Claims, 3 Drawing Sheets

CLEANING TOOL

FIELD

The present disclosure relates to a cleaning tool. In particular, the present disclosure relates to a cleaning tool having a working surface with a portion for contacting the surface to be cleaned and a portion that is recessed from the surface to be cleaned.

BACKGROUND

There are several types of mops for cleaning floors. One type of mop for cleaning floors includes a mop head and a wet or dry cleaning cloth applied over the mop head that is discarded after cleaning. These types of mops often include a flat cleaning surface for contacting the floor. For mops with flat cleaning surfaces for contacting the floor, the leading edge of the flat cleaning surface overloads with dirt, debris, and hair. The excess dirt, debris, and hair are simply pushed around by the mop and are not adequately retained and captured by the cleaning surface of the mop. The excess dirt, debris, and hair may become dislodged during cleaning, or more typically are not retained when the mop is lifted from the floor.

Attempts to recess the cleaning surface from the surface to be cleaned to enhance the surface area available for capturing and retaining dirt, debris, and hair have included providing a wipe having a surface topography or recessing a portion of the cleaning surface of the mop head. Although a wipe including a surface topography enhances its picking up ability, such wipes are more difficult and costly to manufacture. Mops with recessed areas rely on rocking and tilting of the mop to pick up the dirt, debris, and hair. This rocking and tilting makes the mop unstable during use. Also, the constant rocking and tilting can cause dirt, debris, and hair trapped on the raised portion of the cleaning surface to fall from the cleaning surface.

SUMMARY

Generally, the cleaning tool of the present disclosure includes a working surface a portion of which is a contact surface and a portion of which is recessed from the contact surface. The recessed portion aids in capturing and retaining large particles of dirt, dust because the large particles first make contact with the recessed portion prior to making contact with the contact surface. The contact surface is available for capturing and retaining small particles of dirt, dust, debris, and hair. Therefore, the amount of available surface area for cleaning is maximized by including a recessed surface.

Further, the cleaning tool is designed such that the contact surface stabilizes any rocking motion of the working surface. Rocking motion can cause particles to become dislodged from the working surface. It is desirable to minimize rocking of the working surface relative to the surface to be cleaned.

In one embodiment, the cleaning tool comprises a mop head including a perimeter, a working surface and back surface, opposite the working surface. The working surface includes a contact surface and a recessed surface. The contact surface is on a portion of the working surface for making contact with the surface to be cleaned. The contact surface includes a first capturing edge and a second capturing edge. The recessed surface is on a portion of the working surface and includes a first side surface recessed from the first capturing edge of the contact surface and a second side surface recessed from the second capturing edge of the contact surface. The entire contact surface is nonlinear.

In one embodiment, the cleaning tool comprises a mop head including a perimeter, a working surface and back surface, opposite the working surface. The working surface includes a contact surface and a recessed surface. The contact surface is on a portion of the working surface for making contact with the surface to be cleaned. The contact surface includes a first capturing edge and a second capturing edge. The recessed surface is on a portion of the working surface and includes a first side surface recessed from the first capturing edge of the contact surface and a second side surface recessed from the second capturing edge of the contact surface. The contact surface extends along a direction of the x-axis and along a direction of the y-axis, perpendicular to the x-axis, such that along the direction of the x-axis the extension of the contact surface along the direction of the y-axis varies and is nonuniform.

In one embodiment, the cleaning tool comprises a mop head including a working surface and back surface, opposite the working surface, and a perimeter. The working surface includes a contact surface and a recessed surface. The contact surface is on a portion of the working surface for making contact with the surface to be cleaned. The contact surface includes a first capturing edge and a second capturing edge. The recessed surface is on a portion of the working surface and includes a first side surface recessed from the first capturing edge of the contact surface and a second side surface recessed from the second capturing edge of the contact surface. The contact surface includes at least a first extension, a second extension, and a third extension connected at a connection point within the working surface. Each extension extends towards the perimeter.

In one embodiment, the cleaning tool comprises a mop head including a working surface and back surface, opposite the working surface, and a perimeter forming at least a first branch, a second branch, and a third branch. The working surface includes a contact surface and a recessed surface. The contact surface is on a portion of the working surface for making contact with the surface to be cleaned and includes a first capturing edge and a second capturing edge. The recessed surface is on a portion of the working surface and includes a first side surface extending laterally from the first side of the contact surface and toward the back surface and a second side surface extending laterally from the second side of the contact surface and toward the back surface. The contact surface includes at least a first extension in the first branch, a second extension in the second branch, and a third extension in the third branch. The first, second and third extensions connect at a connection point within the working surface, and the first extension extends to a first point on the perimeter, the second extension extends to a second point on the perimeter, and the third extension extends to a third point on the perimeter.

While the above-identified drawings and figures set forth various embodiments, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
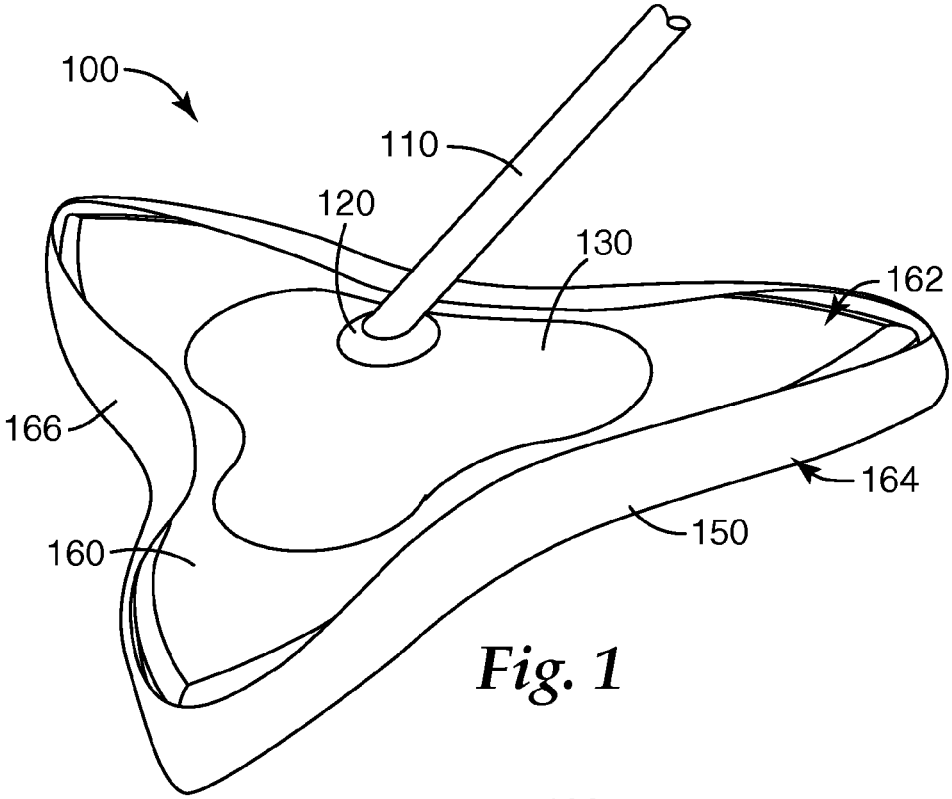
FIG. 1 is a perspective view of one embodiment of a cleaning tool.
Figure 2:
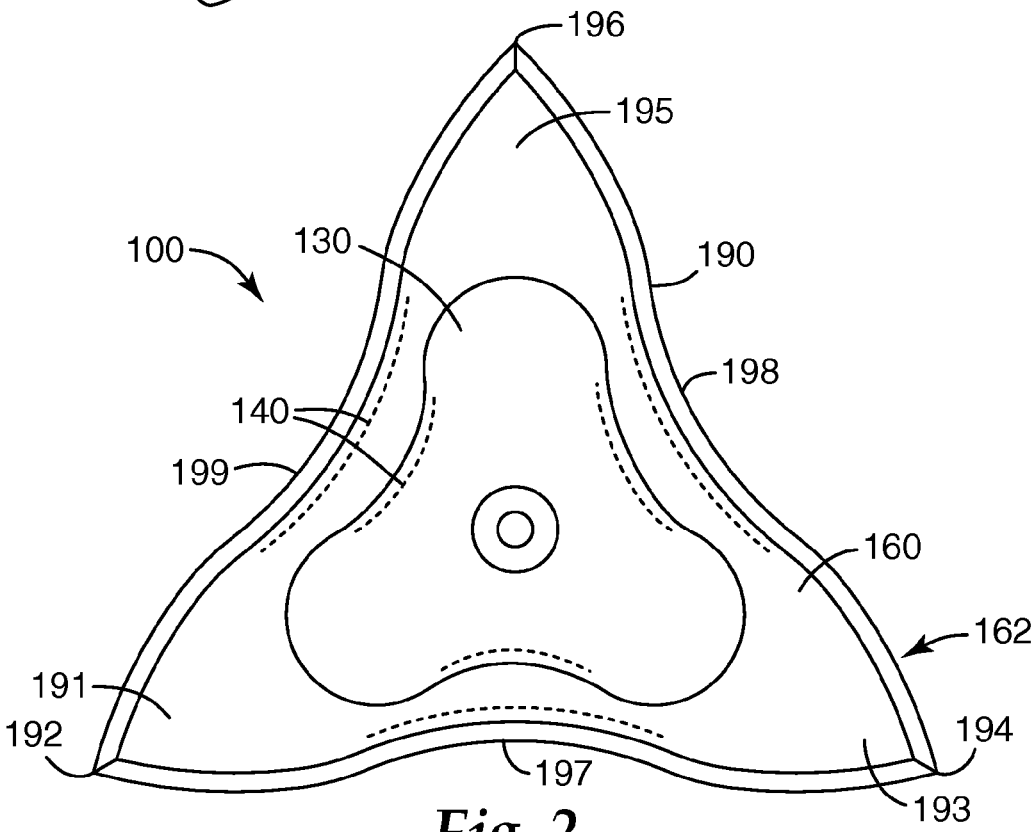
FIG. 2 is a top view of the cleaning tool of FIG. 1.
Figure 3:
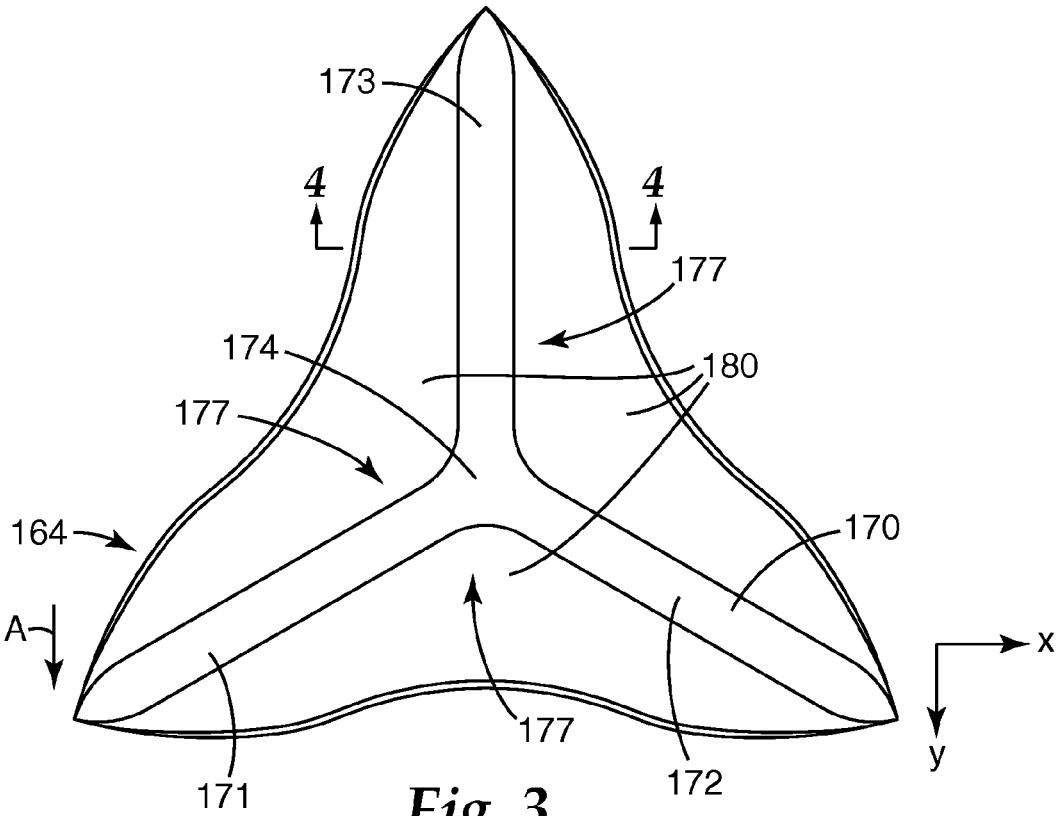
FIG. 3 is a bottom view of the cleaning tool of FIG. 1.

FIG. 1 is a perspective view of one embodiment of a cleaning tool 100. FIG. 2 is a top view, and FIG. 3 is a bottom view of the clean tool 100 of FIG. 1. In one embodiment, a cleaning substrate 150 is applied over the cleaning tool 100, as shown in FIG. 1, to be the cleaning surface that can be removed when finished cleaning.

The cleaning tool 100 includes a mop head 160 with a perimeter 190, a working surface 164 (FIG. 3) facing the surface to be cleaned, and a back surface 162 (FIG. 2), opposite the working surface 164. In the embodiments shown, the mop head 160 also includes a side surface 166 (see FIGS. 1 and 4). The side surface 166 is generally planar and provides a surface for sliding adjacent to a vertical surface to be cleaned. For example, the side surface 166 may slide adjacent a base board to clean and remove dust, lint, or debris from the base board. The cleaning tool 100 may optionally include a support frame 130 secured to the back surface 162 for creating an attachment point for a handle 110. The support frame 130 typically is constructed from a material more rigid than the mop head 160 to give structural support to the mop head 160. A pivot 120 may be included on the handle 110 for aiding in maneuvering the mop head 160 over a surface to be cleaned.

The mop head 160 includes a perimeter 190. Any variety of shapes, sizes, and configurations forming the perimeter 190 are suitable for the cleaning tool 100. In the embodiment shown in FIGS. 1-3, the perimeter 190 form a generally triangular shape and includes a first branching section 191 with a first point 192 along the perimeter 190, a second branching section 193 with a second point 194 along the perimeter 190, and a third branching section 195 with a third point 196 along the perimeter 190. First, second, and third points 192, 194, and 196 are optional, but it may be desirable to include points forming a less than 90 degree angle for cleaning into corners. Between the first branching section 191 and second branching section 193 is a first concave surface 197 along the perimeter 190, between the second branching section 193 and the third branching section 195 is a second concave surface 198, and between the third branching section 195 and first branching section 191 is a third concave surface 199. The concave surfaces are optional, but may be desirable to include concave surfaces along the perimeter 190 for scooping and gathering dirt, debris, and hair during cleaning. As stated above, a variety of other perimeter shapes, including triangular, rectangular, and circular, or such as those disclosed in PCT Publication WO 2007/053380 are within the scope of the disclosure.

The working surface 164 includes a contact surface 170 and a recessed surface 180. The contact surface 170 abuts with or makes direct contact with the surface to be cleaned. The recessed surface 180 does not abut with or make direct contact with the surface to be cleaned, but is recessed from the surface to be cleaned toward the back surface 162. The combination of a contact surface 170 and recessed surface 180 creates a topography directly on the working surface 164 of the cleaning tool 100.

The contact surface 170 can include a variety of configurations, several of which are described herein. The contact surface 170, as a whole, is nonlinear. Generally, the contact surface 170, as a whole, is nonlinear along a direction along an x-axis, which is perpendicular to an intended wiping direction. Nonlinear means that as a whole the contact surface is not in a straight line.

In one embodiment, the contact surface 170, as a whole, extends along a direction of an x-axis and extends along a direction of a y-axis, wherein the x-axis is perpendicular to the y-axis. In particular, the extent to which the contact surface 170 projects in the direction of the y-axis varies along the length of the direction of the x-axis.

A contact surface 170 that, as a whole, is nonlinear creates a more stable contact surface 170 that is not prone to tipping or rocking. When the contact surface is linear or is only along a direction of a single axis and has a constant and uniform lateral projection beyond the direction of that axis the working surface 164 tends to tip and rock. Rocking is unstable and tends to cause once captured dirt, debris, or hair to become dislodged during the rocking motion. The contact surface 170 of the present disclosure is a more stable surface for constant gliding over a surface to be cleaned. In one embodiment, the contact surface 170 is in a single plane, which further aids in preventing rocking of the cleaning tool 100.

The contact surface 170 forms a capturing edge 177, which is the edge of the contact surface 170 and the beginning of the recessed surface 180. The capturing edge 177 on the contact surface 170 aids in collecting dirt, dust, hair and debris and prevents the dirt, dust, hair and debris from passing beyond the contact surface 170. In one embodiment, the capturing edge 177, as a whole, extends continuously along a direction of the x-axis, wherein the x-axis is perpendicular to an intended cleaning direction. A continuous capturing edge 177 prevent large particles of dirt, debris, or particles from passing the contact surface 170 when moving the cleaning tool 100 along an intended wiping direction A. In one embodiment, such as shown in FIG. 3, a variety of capturing edges 177 are formed allowing the cleaning tool 100 to be used in many directions while also preventing large particles of dirt and debris from passing through the contact surface 170.

In the embodiment of FIG. 3, the contact surface 170 includes a first extension 171, a second extension 172, and a third extension 173 all extending from a common connection point 174 to separate points along the perimeter 190 of the mop head 160. The first extension 171 extends to the first point 192 on the perimeter 190, the second extension 172 extends to the second point 194 on the perimeter 190, and the third extension 173 extends to the third point 196 on the perimeter 190. In this embodiment, the first, second and third perimeter points correspond to points on the perimeter 190 furthest from the central connection point 174. Also, in this embodiment, first, second and third points 192, 194, 196 are equidistant from one another.

The contact surface 170, as a whole, is nonlinear. Shown in FIG. 3 are an x-axis and a y-axis. The contact surface 170 extends along a direction of the x-axis and along a direction of the y-axis such that along the direction of the x-axis the extension of the contact surface 170 along the direction of the y-axis varies and is nonuniform. Further, with respect to the intended wiping direction, depicted by letter A, the capturing edge 177 is created to extend generally along a direction along the x-axis, perpendicular to the intended wiping direction A. The continuous capturing edge 177 is created by the contact surface 170 of the first extension 171 and second extension 172 at connection point 174 and each extending out to a perimeter point.

Because the cleaning tool 100 in the embodiment shown in FIGS. 1-3 is symmetrical, the intended wiping direction may be any variety of directions while still maintaining a continuous capturing edge 177 created by the contact surface 170. Therefore, the shape and configuration of the embodiment depicted in FIGS. 1-3 is particular suitable because of its ability to have a capturing edge 177 in any direction the cleaning tool 100 is pushed.

The recessed surface includes side surfaces 181, 182 (FIG. 4-7) on each side of the contact surface 170. The side surfaces 181,182 extend laterally from the contact surface 170 and toward the back surface 162 to form the recessed surface 180. The recessed surface 180 of the working surface 164 of the mop head 160 increases the capture and retention of such debris as dirt, food, lint, and hair because larger particles first contact the recessed surface 180 and become captured at the recessed surface prior to contacting the contact surface 170. Therefore, more surface area is utilized for picking up dirt, food, lint, and hair. Also, the recessed surface 180 creates a tapering area for guiding dust, lint and hair into and adjacent the contact surface 170. The dust, lint, and hair are compacted against the working surface 164 adjacent the contact surface 170, which increases the ability of the cleaning tool 100 to capture this material.

Figure 4:
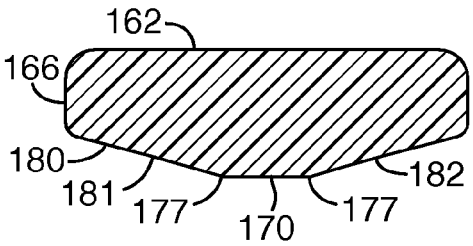
FIG. 4 is a side sectional view of the cleaning tool of FIG. 1, taken along the line 3-3 of FIG. 3.

FIG. 4 is a side sectional view of the cleaning tool 100 along the line 4-4 of FIG. 3. In this embodiment, the contact surface 170 is a flat, planar surface for making contact with the surface to be cleaned. The contact surface 170 is positioned between a first side surface 181 and a second side surface 182. The first side surface 181 extends laterally from the contact surface 170 and toward the back surface 162 of the mop head 160. The second side surface 182 extends laterally of the contact surface 170 and toward the back surface 162 of the mop head 160. A variety of shapes of the side surface may be included. In the embodiment shown in FIG. 4, the side surfaces 181, 182 are flat, planar surfaces that extend from the contact surface 170 toward the back surface 162.

Figure 5:
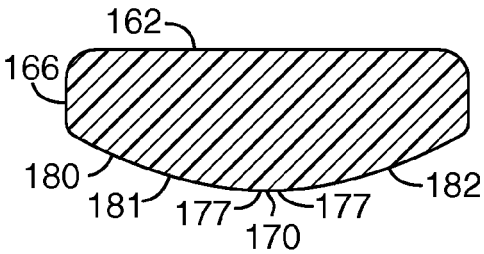
FIG. 5 is a side sectional view of another embodiment of a cleaning tool.
Figure 6:
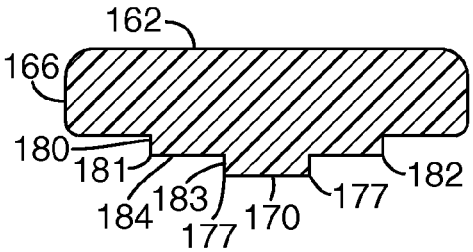
FIG. 6 is a side sectional view of another embodiment of a cleaning tool.
Figure 7:
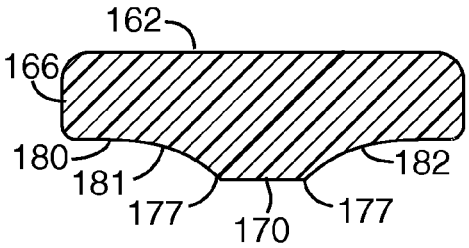
FIG. 7 is a side sectional view of another embodiment of a cleaning tool

FIGS. 5-7 are side sectional views of alternative embodiments showing the contact surface 170 and recessed surface 180. In FIG. 5, the contact surface 170 includes a single point, which forms a line along the length of the contact surface 170 for making contact with the surface to be cleaned. The side surfaces 181, 182, located on either side of the contact surface 170, are convexly curved and extending laterally from the contact surface 170 toward the back surface 162.

In FIG. 6, the contact surface 170 is a flat, planar surface for making contact with the surface to be cleaned. The side surfaces 181, 182, located on either side of the contact surface 170, are stepped and include a riser 183 extending perpendicular to contact surface 170 and a runner 184 extending parallel with the contact surface 170 such that the stepped side surface as a whole extends laterally from the contact surface 170 and towards the back surface 162. It is understood that any number of steps may be included, which may include a single step having one riser 183 and one runner 184.

In FIG. 7, the contact surface 170 is a flat, planar surface for making contact with the surface to be cleaned. The side surfaces 181, 182, located on either side of the contact surface 170, concavely extend laterally from the contact surface 170 and toward the back surface 162.

In FIGS. 4-7, the contact surface 170 and recessed surface 180 are generally symmetrical such that the side surfaces 181, 182 are of the same, but opposite, shape. It is understood that any combination of shapes of side surfaces may be included. For example, one side surface may be flat and planar while the other side surface may be convexly curved.

Figure 11:
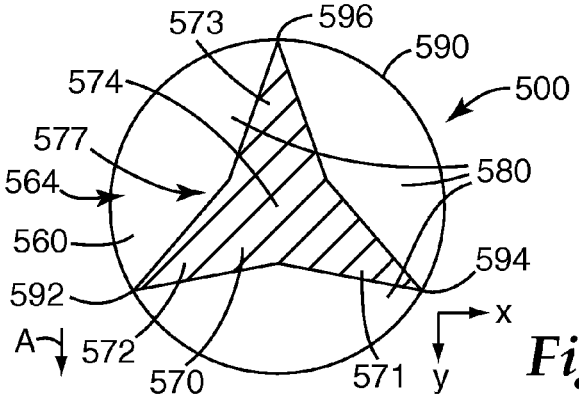
FIG. 11 is a bottom view of another embodiment of a cleaning tool.

As shown by FIGS. 4-7, the contact surface 170 may have a variety of configurations such as being flat and planar or a single line. Further, the contact surface 170 may include a plurality of lines. Also, the contact surface 170 may include protrusions or projections, such as domes or pyramids. If the contact surface is flat and planar (FIGS. 4, 6, and 7), the contact surface may have a constant width, as depicted in FIG. 3, or may have a varying width, as depicted in FIG. 11. It is understood that any combination of contact surfaces may be used with any of the side surfaces to result in a contact surface and recessed surface. For example, in one embodiment, the contact surface is flat and planar while the side surfaces are convexly curved.

In one embodiment, the contact surface includes a width from 0 (line) to 12.5 cm, from 0.1 cm to 7.5 cm, or from 0.25 cm to 3.8 cm. If the contact surface is not a line, then the total area of the contact area depends on a variety of factors including the overall side of the cleaning tool. In one embodiment, the total area of the contact area is at least 1 $in^2$ (6.5 $cm^2$). In another embodiment, the total area of the contact area is between 5 and 27 $in^2$ (32.2 and 175 $cm^2$). In another embodiment, the total area of the contact area is between 9.4 and 15.5 $in^2$ (60 and 100 $cm^2$).

As shown by FIGS. 4-7, the side surface 181, 182 may have a variety of configurations. In one embodiment, whether concave or convex (FIGS. 4, 7), the radius of curvature may range from 0.5 to 10 inches (1.27 cm to 25.4 cm), and in another embodiment from 2 to 8 inches (5 to 20 cm). In one embodiment, the rise of the side surface (FIGS. 5, 6) may range from 0.1 to 5 inches (0.25 to 12.7 cm), and in another embodiment from 0.2 to 0.75 inches (0.5 to 1.9 cm).

In one embodiment, the mop head has a thickness of from 0.5 to 4 inches (1.27 to 10 cm). In one embodiment, the mop head has a thickness of from 0.75 to 2 inches (1.9 to 5 cm). In one embodiment, the total area of the working surface is at least 10 $in^2$ (64.5 $cm^2$). Typically, the total area of the working surface is between 10 in and 200 $in^2$ (64.5 $cm^2$ and 1290 $cm^2$), and more typically between 20 $in^2$ and 100 $in^2$ (129 $cm^2$ and 645 $cm^2$).

The mop head 160 may be formed from a single material. The mop head 160 may be a single, homogeneous construction of a single material. A homogeneous construction of the mop head 160 is a more simplified, cost efficient construction. In such an embodiment, the mop head 160 can be made by a variety of known molding techniques.

The mop head 160 can be made of a flexible material. Exemplary materials for the mop head 160 include all types of foam, porous rubber, silicon, synthetics, synthetic foams, formed polyester, cellulose materials, sponge materials. Specific exemplary materials or material substrates include polyether or polyester, low or high density, small, large or twin pore sizes, closed or open cell, non or flame retardant, flexible or semi rigid, plain, melamine or post treated impregnated foams, and the like. Also, neoprene, natural rubber, SBR, butyl, butadiene, nitrile, EPDM, ECH, polystyrene, polyethylene, polypropylene, EVA, EMA, metallocene resin, polyurethane, PVC, blends of any of the above, and the like. Natural sponges can be used and include those from the aquatic animal phylum Porifera, and from the dried, processed skeletons of certain species used to hold water, for example. Preferably, cellulose-based sponges can be used. Cellulose-based sponges can include those which are derived from plant products for example. More preferably, synthetic foam can be used, and even more preferably synthetic foam can be used on at least one face and polyester on at least one face. Synthetic sponges can be constructed of porous rubber, synthetic foam, other plastic and rubber derivatives, and the like, for example.

In another embodiment, the mop head 160 may be formed from a combination of materials. For example, the recessed surface may be formed of a foam, such as those listed above, and the contact surface may be made of a plastic, metal, wood, glass, or other more rigid material. In such an embodiment, the contact surface may be made of a more stiff or rigid material to allow the contact surface to better glide over the surface to be cleaned.

A flexible, foam material may provide a particularly useful material for use as the cleaning tool. A flexible material allows for slight flexing and contouring along the surface to be cleaned. Also, a flexible material will flex and contour when pushed against walls and furniture, therefore minimizing damage. The foam may be capable of retaining water or solvent. In one embodiment the foam has a stiffness of from 40 to 100 and in another embodiment the foam has a stiffness from 60 to 95. Foam stiffness is measured with a PTC Instruments "Sponge Rubber Gauge" Model 302SL with a 0-100 index value.

The cleaning tool 100 can be used independently for wet mopping a floor. Alternatively, the cleaning tool 100 can be used with a cleaning substrate 150, such as shown in FIG. 1, for either dry dust moping or wet moping. When used with a cleaning substrate 150, the topography created by the contact surface 170 and the recessed surface 180 should remain discernable. The loft or thickness of the cleaning substrate 150 or the rise of the recessed surface 180 relative to the contact surface 170 may impact whether the topography is discernable once the cleaning substrate 150 is included.

Suitable cleaning substrates 150 include woven or knitted cloth or nonwoven web form from natural, synthetic, or a combination of natural and synthetic fibers. A nonwoven web can be prepared by any suitable melt forming or mechanical forming operation. For example, the nonwoven webs may be carding, garneting, airlaying, spunbond, wet-laying, melt blowing, stitchbonding or made by other processes as are known in the art. Further processing of a nonwoven may be necessary to add properties such as strength, durability, and texture. Examples of further processing include calendering, hydroentangling, needletacking, resin bonding, thermobonding, ultrasonic welding, embossing, and laminating.

Fibers for making the nonwoven web may be made from thermoplastic polymers. Suitable thermoplastic polymers can be selected from polyolefins (such as polyethylenes, polypropylenes, and polybutylenes), polyamides (such as nylon 6, nylon 6/6, and nylon 10), polyesters (such as polyethylene terephthalate), copolymers containing acrylic monomers, and blends and copolymers thereof. Semi-synthetic fibers (such as acetate fibers), natural fibers (such as cotton), regenerated fibers (such as rayon), and other non-thermoplastic fibers can made into a web or can be blended with the thermoplastic fibers.

In one embodiment, the fibers typically have a denier of from about 1 to about 50, more preferably from about 6 to about 25. In one embodiment, the nonwoven has a basis weight from about 10 to about 200 grams per square meter, and more preferably from about 30 to about 150 grams per square meter.

The nonwoven web may include an additive to aid in capturing and retaining dirt, debris, or hair during cleaning. The additive may include waxes, oils, or adhesives. Suitable adhesives include any that are capable of being tacky at room temperature, including both adhesives that are initially tacky and those that are initially non-tacky but which can be activated to become tacky. Suitable adhesives include any pressure-sensitive adhesives, including materials based on acrylates, silicones, poly-alpha-olefins, polyisobutylenes, rubber block copolymers (such as styrene/isoprene/styrene and styrene/butadiene/styrene block copolymers), styrene butadiene rubbers, synthetic isoprenes, natural rubber, and blends thereof. A nonwoven web containing adhesive that may be suitable for use with the cleaning tool 100 is disclosed in US patent application publication 2006/0141881. A nonwoven web containing adhesive that is particularly suitable for use with the cleaning tool 100 is disclosed in US patent application publication US2005-0014434 titled "Cleaning Wipe and Method of Manufacture," because this nonwoven web can include adhesive available over the entire surface.

The cleaning substrate 150 can be attached to the cleaning tool 100 by a variety of attachment mechanisms 140. When the cleaning substrate 150 is a woven, knitted, or nonwoven, the cleaning substrate 150 may serve as a loop for attaching to a hook or stem placed on the cleaning tool 100. The attachment mechanism 140 may be hooks or stems and can project from the back surface 162 of the mop head 160 or from the support frame 130, if included. FIG. 2 shows the attachment mechanism 140 on both the back surface 162 and the support frame 130. However, it is understood that the attachment mechanism 140 may be included at only one of these locations. Further, it is understood that the attachment mechanism 140 may be included around an entire perimeter of any one of these identified locations or may be included at only a portion of the perimeter of any one of these identified locations so long as the cleaning substrate 150 is sufficiently secured to the cleaning tool 100. The hook or stem can project from a portion of the working surface 164 such as on the recessed surface 180. Other types of attachment mechanisms 140 are within the scope of the disclosure including pinch points, mechanical fasteners, or adhesive.

The size and shape of the cleaning substrate 150 should be at least large enough to cover the entire working surface 164. Depending on the placement of the attachment mechanism, the cleaning substrate 150 may need to be larger than the working surface 164 in order to wrap around the mop head 160 and secure with the attachment mechanism 140.

FIGS. 8-11 show bottom views of alternative embodiments of cleaning tools. In each of these embodiments the contact surface is depicted, and it is understood that on a cross-sectional view there may be different configurations of the contact surface and side surfaces, such as those depicted in FIGS. 4-7. Also, for each of the embodiments depicted in FIGS. 8-11, x and y axes are shown, and an intended wiping direction A is shown, which is perpendicular to the x-axis.

Figure 8:
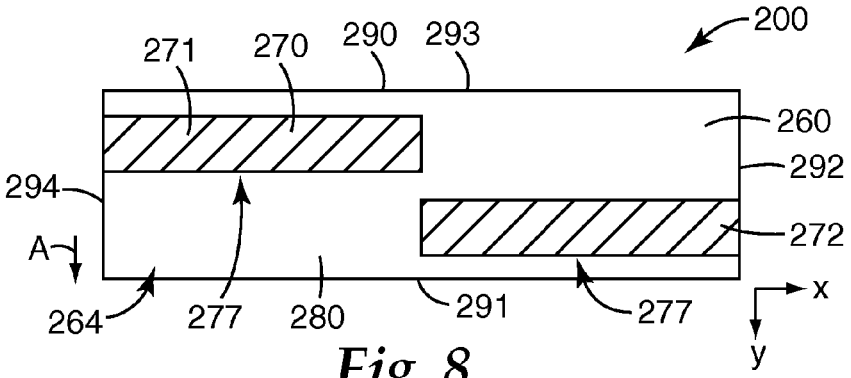
FIG. 8 is a bottom view of another embodiment of a cleaning tool.

FIG. 8 is a bottom view of a cleaning tool 200. The cleaning tool 200 includes a mop head 260 having a perimeter 290 and a working surface 264. In this embodiment the perimeter 290 is generally rectangular with a first side 291, second side 292, third side 293, opposite the first side 291, and a fourth side 294, opposite the second side.

The working surface 264 includes a contact surface 270, shown cross-hatched, and a recessed surface 280. The contact surface 270 abuts with or makes direct contact with the surface to be cleaned. The recessed surface 280 does not abut with or make direct contact with the surface to be cleaned, but is recessed from the surface to be cleaned. The combination of a contact surface 270 and recessed surface 280 creates a topography directly on the working surface 264 of the cleaning tool 200.

The contact surface 270 as a whole is nonlinear. The contact surface 270 extends along a direction of an x-axis, which is perpendicular to the intended cleaning direction A, to create a capturing edge 277. In this embodiment, the capturing edge 277, as a whole, is a continuous edge along the direction of the x-axis to prevent dirt, debris, or particles from passing the contact surface 270 when moving the cleaning tool 200 along an intended wiping direction A. The contact surface 270 also laterally extends from the direction of the x-axis along a direction of a y-axis nonuniformly along the direction of the x-axis.

In the embodiment of FIG. 8, the contact surface 270 includes a first extension 271 and a second extension 272. The first extension 271 extends to the fourth side 294 on the perimeter 290 and the second extension 272 extends to the second side 292 on the perimeter 290. The first extension 271 is offset from the second extension 272 resulting in the contact surface 270, as a whole, being nonlinear. The offset first extension 271 and second extension 272 cause in the contact surface 270, as a whole, to laterally extend in the direction of the y-axis nonuniformly along the direction of the x-axis. Because the first extension 271 of the contact surface 270 is offset from the second extension 272 of the contact surface 270, the working surface is more stable and less inclined to rock than if the first extension 271 and second extension 272 were aligned and linear.

Even though the contact surface 270 is disconnected, the capturing edge 277 created is continuous along a direction along the x-axis. This prevents large dirt, debris and particles from passing through the capturing edge 277 and contact surface 270.

Figure 9:
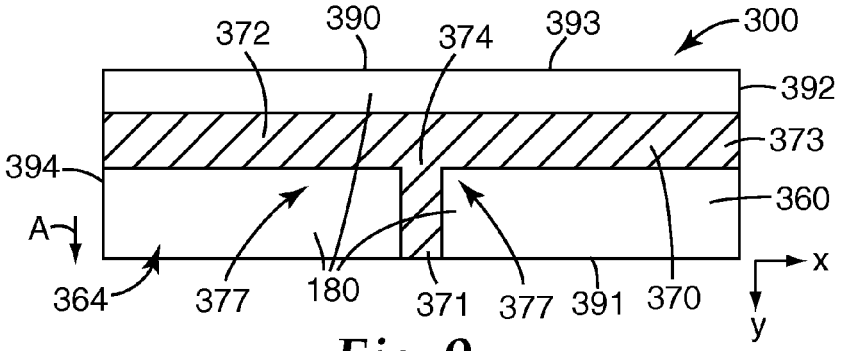
FIG. 9 is a bottom view of another embodiment of a cleaning tool.

FIG. 9 is a bottom view of a cleaning tool 300. The cleaning tool 300 includes a mop head 360 having a perimeter 390 and a working surface 364. In this embodiment, the perimeter 390 is generally rectangular with a first side 391, second side 392, third side 393, opposite the first side 391, and a fourth side 394, opposite the second side.

The working surface 364 includes a contact surface 370, shown cross-hatched, and a recessed surface 380. The contact surface 370 abuts with or makes direct contact with the surface to be cleaned. The recessed surface 380 does not abut with or make direct contact with the surface to be cleaned, but is recessed from the surface to be cleaned. The combination of a contact surface 370 and recessed surface 380 creates a topography directly on the working surface 364 of the cleaning tool 300.

The contact surface 370, as a whole, is nonlinear. The contact surface 370 extends along a direction of an x-axis, which is perpendicular to the intended cleaning direction A, to create a capturing edge 377. The capturing edge 377 is a continuous edge along the direction of the x-axis to prevent dirt, debris, or particles from passing the contact surface 370 when moving the cleaning tool 300 along an intended wiping direction A. The contact surface 370 also laterally extends from the direction of the x-axis along a direction of a y-axis nonuniformly along the direction of the x-axis.

In the embodiment of FIG. 9, the contact surface 370 includes a first extension 371 and a second extension 372. The first extension 371 linearly extends from the second side 392 to the fourth side 394. The second extension 372 extends from a connection point 374 with the first extension 372 to the first side 391. The second extension 272 causes the contact surface 270, as a whole, to be nonlinear. The second extension 272 causes the contact surface 370, as a whole, to laterally extending in the direction of the y-axis nonuniformly along the direction of the x-axis. Because the second extension 372 of the contact surface 370 extends in the direction of the y-axis, the working surface is more stable and less inclined to rock.

The capturing edge 377 is continuous along a direction along the x-axis. This prevents large dirt, debris and particles from passing through the capturing edge 377 and contact surface 370.

Figure 10:
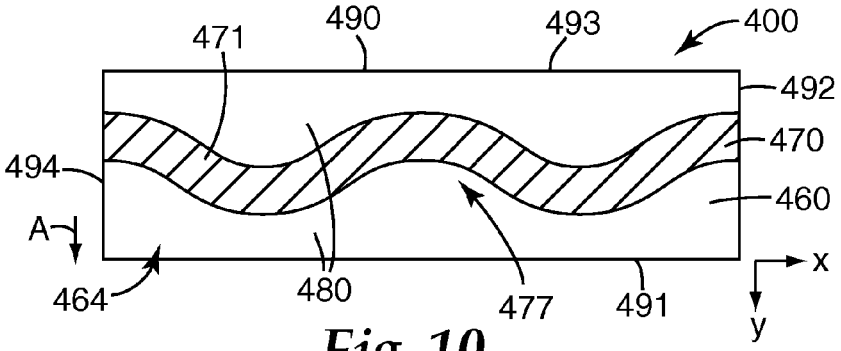
FIG. 10 is a bottom view of another embodiment of a cleaning tool.

FIG. 10 is a bottom view of a cleaning tool 400. The cleaning tool 400 includes a mop head 460 having a perimeter 490 and a working surface 464. In this embodiment the perimeter 490 is generally rectangular with a first side 491, second side 492, third side 493, opposite the first side 491, and a fourth side 494, opposite the second side 492.

The working surface 464 includes a contact surface 470, shown cross-hatched, and a recessed surface 480. The contact surface 470 abuts with or makes direct contact with the surface to be cleaned. The recessed surface 480 does not abut with or make direct contact with the surface to be cleaned, but is recessed from the surface to be cleaned. The combination of a contact surface 470 and recessed surface 480 creates a topography directly on the working surface 464 of the cleaning tool 400.

The contact surface 470, as a whole is nonlinear. The contact surface 470 extends along a direction of an x-axis, which is perpendicular to the intended cleaning direction A, to create a capturing edge 477. The capturing edge 477 is a continuous edge along the direction of the x-axis and prevents dirt, debris, or particles from passing the contact surface 470 when moving the cleaning tool 400 along an intended wiping direction A. The contact surface 470 also laterally extends from the direction of the x-axis along a direction of a y-axis nonuniformly along the direction of the x-axis.

In the embodiment of FIG. 10, the contact surface 470 includes a single extension 471 that extends from the second side 492 to the fourth side 494 of the working surface in a wave-like manner to cause the contact surface to be nonlinear. Further, the wave-like contact surface results in a contact surface 470 that laterally extend along the direction of the y-axis nonuniformly along the direction of the x-axis. The wave-like shape and lateral extension along the y-axis in a nonuniform manner along the x-axis causes the working surface to be more stable and less inclined to rock than if the extension 471 was linear.

The capturing edge 477 is continuous along a direction along the x-axis. This prevents large dirt, debris and particles from passing through the capturing edge 477 and contact surface 470.

FIG. 11 is a bottom view of a cleaning tool 500. The cleaning tool 500 includes a mop head 560 having a perimeter 590 and a working surface 564. In this embodiment, the perimeter 590 is generally circular.

The working surface 564 includes a contact surface 570, shown cross-hatched, and a recessed surface 580. The contact surface 570 abuts with or makes direct contact with the surface to be cleaned. The recessed surface 580 does not abut with or make direct contact with the surface to be cleaned, but is recessed from the surface to be cleaned. The combination of a contact surface 570 and recessed surface 580 creates a topography directly on the working surface 564 of the cleaning tool 500.

The contact surface 570, as a whole, is nonlinear. The contact surface 570 extends along a direction of an x-axis, which is perpendicular to the intended cleaning direction A, to create a capturing edge 577. The capturing edge 577 is a continuous edge along the direction of the x-axis that prevents dirt, debris, or particles from passing the contact surface 570 when moving the cleaning tool 500 along an intended wiping direction A. The contact surface 570 also laterally extends from the direction of the x-axis along a direction of a y-axis nonuniformly along the direction of the x-axis.

In the embodiment of FIG. 11, the contact surface 570 includes a first extension 571, a second extension 572, and a third extension 573 all extending from a common connection point 574 to separate points along the perimeter 590 of the mop head 560. The first extension 571 extends to the first point 592 on the perimeter 590, the second extension 572 extends to the second point 594 on the perimeter 590, and the third extension 573 extends to the third point 596 on the perimeter 590. In this embodiment, the first, second, and third perimeter points correspond to points on the perimeter 190 equidistant from one another. As with the embodiment shown in FIG. 3, the first extension 571, second extension 572, and third extension 573 create a working surface more stable and less inclined to rock as the contact surface 570, as a whole, is nonlinear and extends along the direction of both the x-axis and the y-axis.

The capturing edge 577 is continuous along a direction along the x-axis. This prevents large dirt, debris and particles from passing through the capturing edge 577 and contact surface 570.

It is understood that the cleaning tools shown in the embodiments of FIGS. 8-10 can include the shapes, sizes, materials, and cleaning substrate as was disclosed for the embodiment of FIGS. 1-3. Further, that the cleaning tools may be used alone or with a cleaning substrate placed over the working surface. If a cleaning substrate is used over the working surface then an appropriately shaped cleaning substrate should be used over the corresponding shape of the working surface and location of the attachment points. Also, if a cleaning substrate is used over the working surface the topography of the working surface should remain discernable.

It is understood that although the embodiments were described with an intended wiping direction A, the cleaning tool may be used in any wiping direction. In some embodiments, the cleaning tool maintains a continuous contact edge regardless of the wiping direction (FIGS. 3 and 11).

Generally, the cleaning tool of the present disclosure includes a working surface a portion of which is a contact surface and a portion of which is recessed from the contact surface. The recessed portion aids in capturing and retaining large particles of dirt, dust because the large particles first make contact with the recessed portion prior to making contact with the contact surface. The contact surface is available for capturing and retaining small particles of dirt, dust, debris, and hair. Therefore, the amount of available surface area for cleaning is maximized by including a recessed surface.

Further, the cleaning tool is designed such that the contact surface stabilizes any rocking motion of the working surface. Rocking motion can cause particles to become dislodged from the working surface. It is desirable to minimize rocking of the working surface relative to the surface to be cleaned.

Although specific embodiments have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A floor cleaning tool comprising:

a mop head including a working surface and back surface, opposite the working surface, and a perimeter forming at least a first branch, a second branch, and a third branch;

a contact surface on a portion of the working surface for making contact with the surface to be cleaned, wherein the contact surface includes a first capturing edge, a second capturing edge, and a third capturing edge;

a recessed surface on a portion of the working surface, the recessed surface includes a first side surface extending laterally from the first capturing edge and toward the back surface, a second side surface extending laterally from the second capturing edge and toward the back surface, and a third side surface extending laterally from the third capturing edge and toward the back surface;

wherein the contact surface includes at least a first extension in the first branch, a second extension in the second branch, and a third extension in the third branch, wherein the first, second and third extensions connect at a connection point within the working surface and wherein the first extension extends to a first point on the perimeter, the second extension extends to a second point on the perimeter, and the third extension extends to a third point on the perimeter, and further wherein the first-third extensions separate the first-third side surfaces from one another.

2. The cleaning tool of claim 1, wherein the first capturing edge as a whole is continuous along a direction of an x-axis, which is perpendicular to an intended wiping direction.

3. The cleaning tool of claim 1, further comprising a cleaning substrate placed over the working surface.

4. The cleaning tool of claim 1, wherein the first side surface and second side surface are selected from the group consisting of straight sides, stepped sides, concave sides, and convex sides.

5. The cleaning tool of claim 1, wherein the mop head is of a homogeneous material construction.

6. The cleaning tool of claim 1, wherein the mop head is flexible material.

7. The cleaning tool of claim 1, wherein the contact surface is symmetrical about a connection point.

8. The cleaning tool of claim 1, wherein the contact surface is in a single plane.

9. The cleaning tool of claim 1, wherein the first point, second point, and third point are equidistant from one another.

10. The floor cleaning tool of claim 1, wherein the mop head further comprises planar side walls for cleaning adjacent a vertical surface.

* * * * *